US006126029A

United States Patent [19]

Storgaard

[11] Patent Number: 6,126,029

[45] Date of Patent: Oct. 3, 2000

[54] CAN WITH A COVER PROVIDED WITH A PULL RING

[75] Inventor: Bo Storgaard, Vejle, Denmark

[73] Assignee: Glud & Marstrand A/S, Denmark

[21] Appl. No.: 09/254,809

[22] PCT Filed: Sep. 25, 1997

[86] PCT No.: PCT/DK97/00407

§ 371 Date: Mar. 15, 1999

§ 102(e) Date: Mar. 15, 1999

[87] PCT Pub. No.: WO98/13268

PCT Pub. Date: Apr. 2, 1998

[30] Foreign Application Priority Data

Sep. 26, 1996 [DK] Denmark ..... 1049/96

[51] Int. Cl.[7] ..... B65D 17/34

[52] U.S. Cl. ..... 220/271; 220/276; 206/508; 206/509

[58] Field of Search ..... 220/269, 270, 220/271, 276; 206/508, 509, 512

[56] References Cited

U.S. PATENT DOCUMENTS

| | | | |
|---|---|---|---|
| 1,650,520 | 11/1927 | Johnson . | |
| 3,499,573 | 3/1970 | Adams | 220/271 |
| 3,501,046 | 3/1970 | Jasper et al. . | |
| 3,586,203 | 6/1971 | Powell . | |
| 3,762,596 | 10/1973 | Henning . | |
| 3,915,334 | 10/1975 | Patel . | |
| 4,002,262 | 1/1977 | Khoury | 220/271 |
| 4,014,455 | 3/1977 | LaCroce | 220/269 |
| 4,044,915 | 8/1977 | LaCroce et al. | 220/270 |
| 4,182,460 | 1/1980 | Holk, Jr. et al. . | |
| 5,038,956 | 8/1991 | Saunders | 220/271 |
| 5,217,134 | 6/1993 | Saunders | 220/276 |

FOREIGN PATENT DOCUMENTS

| | | |
|---|---|---|
| 40 10 660 A1 | 10/1991 | Germany . |
| 364235 | of 0000 | Sweden . |
| WO84/03850 | 3/1984 | WIPO . |
| WO88/05406 | 9/1987 | WIPO . |

*Primary Examiner*—Stephen K. Cronin
*Attorney, Agent, or Firm*—Scully, Scott, Murphy & Presser

[57] ABSTRACT

A can with a cover comprises a pull ring (5) and a score line (7) adjacent the closing flange (8) of the cover, and a bottom closing flange (9). The nose (5*b*) of the pull ring (5) is spaced such a distance (x) from the weakening line (7) that two cans (1', 1) can be stacked atop one another without any risks of damaging the pull ring. When the handle part (5*a*) is lifted, the pull ring is displaced the distance (x) outwards towards the cover flange (8) before it perforates the cover through the score line (7). The resulting can is less vulnerable compared to known cans at the score line during handling and can thus withstand heavy vertical loads. Moreover more room is provided for a closing chuck at the seaming of the cover.

11 Claims, 4 Drawing Sheets

CAN WITH A COVER PROVIDED WITH A PULL RING

TECHNICAL FIELD

The invention relates to a can of the type indicated in the preamble of claim 1.

BACKGROUND ART

A circular can with a cover and a bottom member has been known for a long time, where the cover and the bottom member are secured by means of a closing flange to the cylindrical body of the can. The top side of the cover is provided with a pull ring, viz. an easy-open device, as well as upwardly projecting stacking projections, and the bottom member is provided with corresponding stacking projections. When two identical cans are stacked atop one another, the pull ring is almost completely protected from bumps and impacts because the stacking projections transfer the vertical pressure between the cans while they simultaneously maintain such a distance between the cover of the lower can and the bottom surface of the upper can that the pull ring is not squeezed. Such a can is, however, not completely satisfactory because the projections interfere with the distribution of the material in the cover which may cause undesired tensions in said material and consequently weak, i.e. leaking portions at the score line during the handling of the can. Furthermore it turned out that a very high number of cans of this type stacked atop one another involves a risk of the lower can leaking already when it is subjected to a vertical load of approximately 40 N. In addition, the manufacture of such a can is not as easy as it should be because when the cover is to be seamed onto the body of the can it is not easy to make room for a closing chuck between the nose of the pull ring and the cover closing flange, said closing chuck functioning as a counter-tool for the seaming implement.

U.S. Pat. No. 1,650,520 discloses a stackable can with a cover and a bottom member but without a pull ring.

U.S. Pat. No. 4,182,460 discloses a can with a cover provided with a pull ring and a score line. The pull ring does not present a slit in its intermediary portion.

BRIEF DESCRIPTION OF THE INVENTION

The object of the invention is to provide a can of the above type which compared to known cans is less vulnerable at the score line during the handling procedure, which can withstand a vertical load of up to 600 N without leaking and without the pull ring being damaged, and which is easy to manufacture because it allows room in a better manner than the known cans for a closing chuck at the seaming of the cover. Further, the can must be easier to open than the prior art cans.

The can according to the invention is characterised in the features indicated in the characterising clause of claim 1.

As a result it is possible to completely avoid the known projections increasing the risk of leaks. In addition, the width of the bottom flange can be increased and thereby provide a large area absorbing the vertical stacking pressure exerted on the cover of the can without thereby causing the bottom flange to destroy the pull ring of the lower can significantly. The latter is obtained because the nose of the pull ring is positioned at a distance away from the cover closing flange of this can in the stacked position of said can. It is not possible for the nose to be pressed at the wrong moment downwards into the score line by the bottom flange thereabove, because the space between said nose and the cover flange is improved. As the bottom flange is of a considerable height, a sufficient distance is ensured between the cover of a can and the bottom surface of the can stacked thereon. The can according to the invention is furthermore easy to manufacture because the increased space between the nose of the pull ring and the cover closing flange allows an easy insertion of a closing chuck towards the cover, i.e. on the location where the cover closing flange is to be provided. When the can is opened, the nose slides in a first phase in a particularly reliable manner outwards towards the cover closing flange, i.e towards the score line. This happens when the handle part of the pull ring is slightly lifted. In the next phase of the opening of the can, the pull ring is turned further on over the edge of the cover flange, the pull ring functioning as a lever.

Furthermore, according to the invention the auxiliary score line is spaced from the score line, preferably at a distance of at least 2 mm. This embodiment has proved particularly reliable.

Before the handle part of the pull ring is lifted by the user, the tip of the nose may according to the invention be spaced from the inner wall of the cover flange when seen in the radial direction a distance of 2 to 4 mm, preferably 2.5 to 3.5 mm. Such an embodiment turned out to allow a suitably large width of the bottom flange, whereby the bottom surface of the latter towards the cover therebelow is increased.

Finally, the body of the can, the cover member and the bottom member may according to the invention be made of metal sheet of a thickness of 0.1 to 1.5 mm, which turned out to be a suitable thickness relative to the weight of the articles ordinarily to be contained in the can.

BRIEF DESCRIPTION OF THE DRAWINGS

The invention is explained in detail below with reference to the drawings, in which.

BEST MODE FOR CARRYING OUT THE INVENTION

Figure 1A:
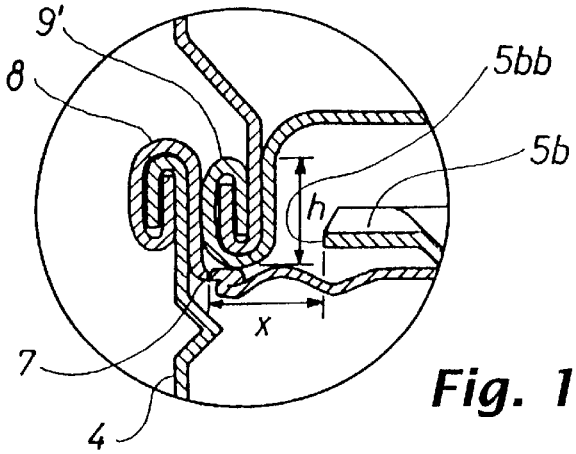
FIG. 1A is an enlarged view of a portion of FIG. 1, showing the area between the nose of the pull ring of the lower can and the cover closing flange of said can.
Figure 1:
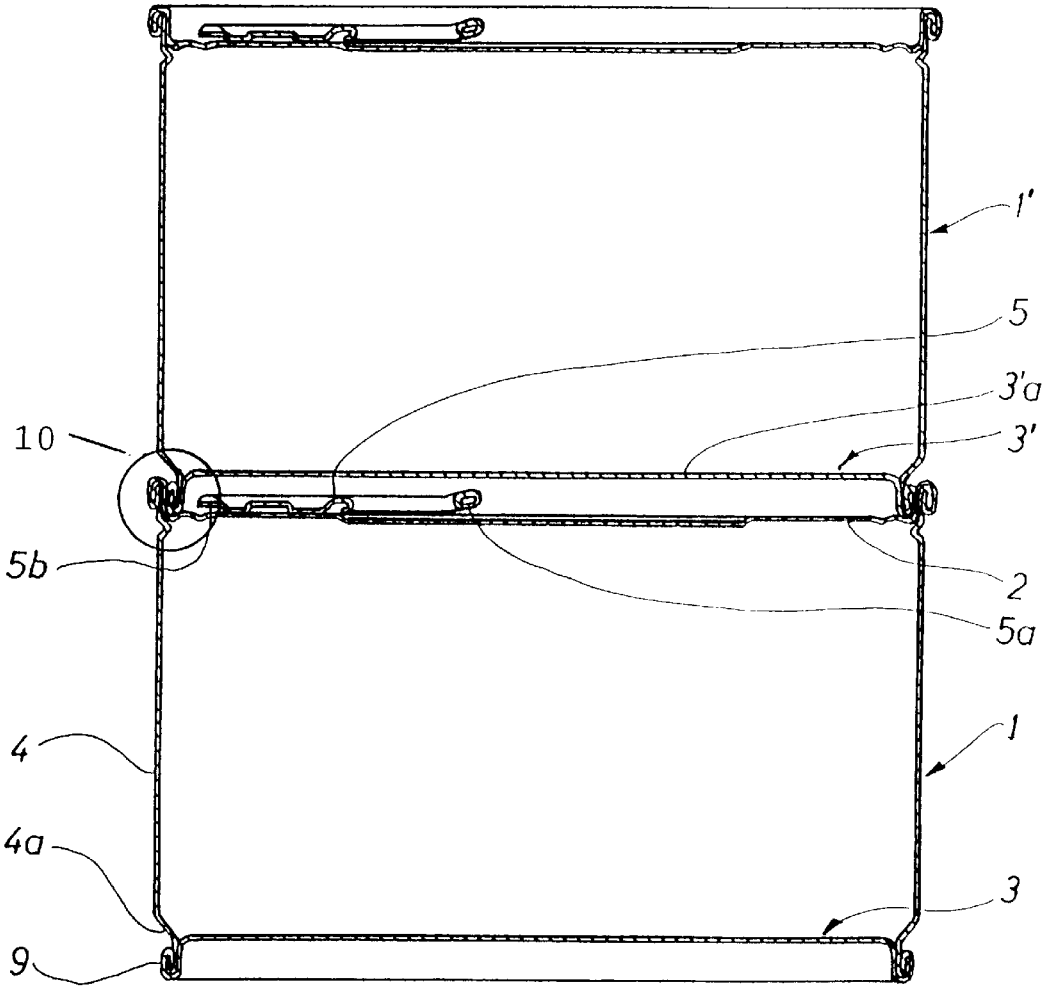
FIG. 1 is a vertical sectional view of two cans according to the invention stacked atop one another.

The cans 1 and 1' illustrated in FIG. 1 are identical and stacked atop one another. The can 1 comprises a cover 2 and a bottom member 3 secured to the body 4 of a can. The cover 2 is provided with a pull ring 5 with a nose 5*b*. A score line 7 is provided in the cover 2 adjacent, preferably inside a distance of 0.5 mm from a circumferential cover closing flange 8 shaped between said cover and the body 4 of the can. The resulting can is particularly suited for packing of formed articles, such as formed articles of meat, but it can, however, also be used for many other types of articles. The bottom member 3 is secured to a lowermost portion 4*a* necked in of the body 4 of the can by means of a circumferential bottom closing flange 9.

On the upper can 1' all the relevant parts have the same reference numerals as on the lower can 1, whereby, however, a "mark" has been added.

FIG. 1A is an enlarged view of the portion designated as 10 in FIG. 1.

The nose 5*b* on the pull ring 5 of the lower can is provided at such a distance x from the score line 7 that the bottom flange 9' of this can 1' has room between the cover flange 8 of the lower can and said nose 5*b* when two cans are stacked atop one another. The bottom flange 9' of the upper can is of such a height that said bottom flange 9' stands directly on the cover 2 of the lower can without touching the pull ring 5 when said two cans are stacked atop one another, Furthermore, the bottom surface 3*a* of the bottom member 3 does not touch the pull ring 5. The pull ring 5 is shaped such that when a user pulls in the handle part 5*a,* said ring is displaced a distance corresponding to the above distance x outwards towards the cover flange 8 before the tip 5*b* of the nose is forced downwards into the score line 7 of the cover.

Such a can is less vulnerable than the known cans because the bottom flange 9' can be made very broad, as a matter of fact its width can match the distance x whereby the vertical forces to be transferred from can to can are distributed across a relatively large area on the can cover. Accordingly, the score line 7 is not as vulnerable as previously experienced. It turned out that the can according to the invention can stand a vertical load of up to 600 N without leaking neither at the score line nor at the cover closing flange 8, and without the pull ring 5 being damaged by the surface 3'*a* of the bottom member 3 of the upper can. As the above distance x is rather large, preferably 1 to 3 mm, more room than previously is provided during the seaming of the cover where the pull ring 5 has been mounted in advance, said room being provided for a closing chuck between the closing flange of the cover and the nose. The closing chuck forms the basis for an additional folding implement.

Figure 2:
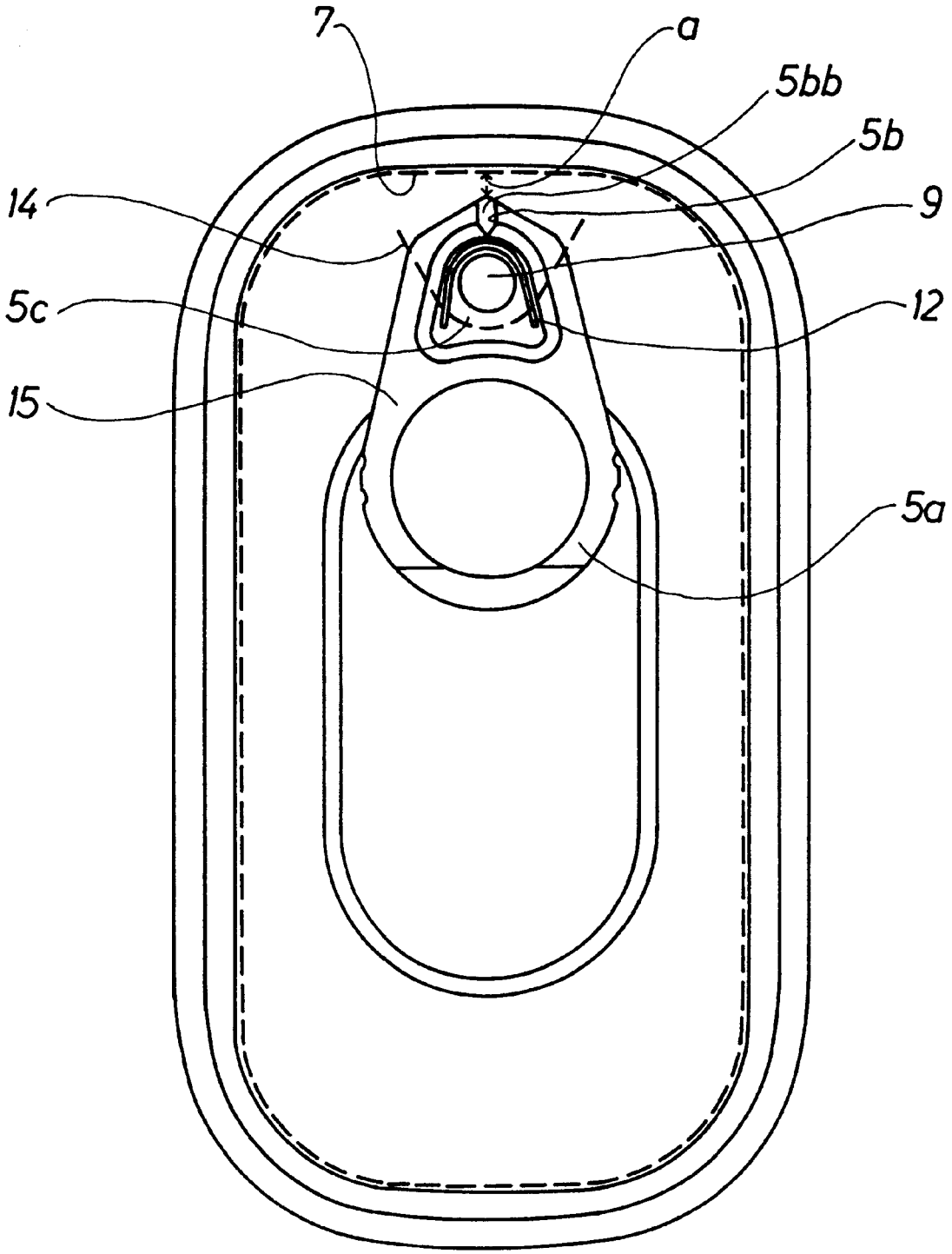
FIG. 2 is a top view of a can according to the invention, where it is clearly shown that the nose of the pull ring is considerably spaced from the cover closing flange before the can is opened.
Figure 3:
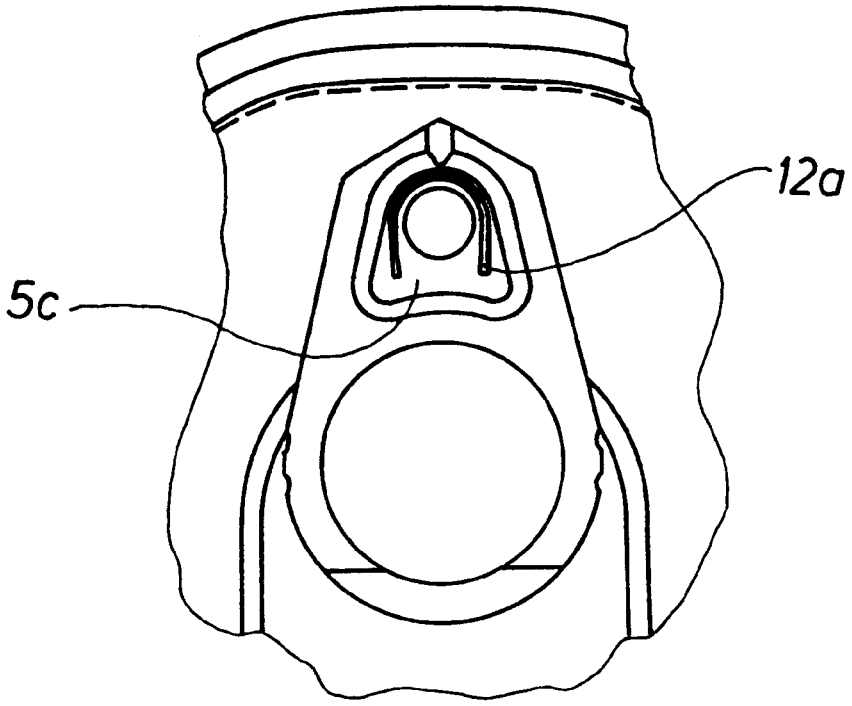
FIG. 3 is a top view of a pull ring, where the slit in the intermediary portion is substantially U-shaped.
Figure 4:
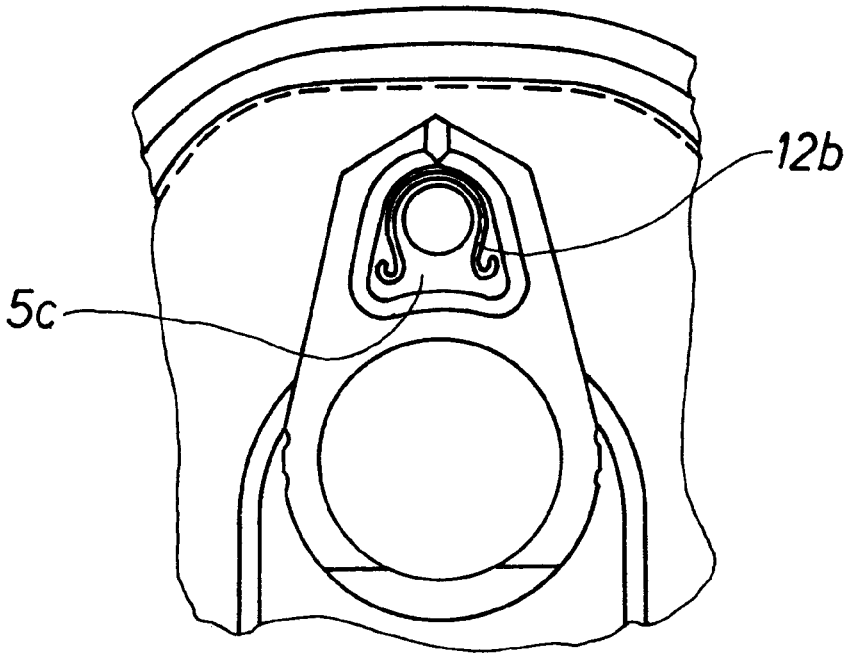
FIG. 4 is a top view of a pull ring, where the slit in the intermediary portion is substantially lyre-shaped.

As illustrated in FIG. 2, the pull ring 5 in addition to the handle part 5*a* and the nose 5*b* comprises an intermediary portion 5*c* arranged between the latter two parts and rivetted to the cover, such as by means of a hollow rivet 9. The intermediary portion comprises a substantially curved slit 12 extending around the rivet 9, the hollow side of said slit facing away from the nose 5*b*. The slit 12 may be shaped in mary different ways, such as U-shaped as shown in FIG. 3 or be lyre-shaped as shown in FIG. 4.

Figure 5:
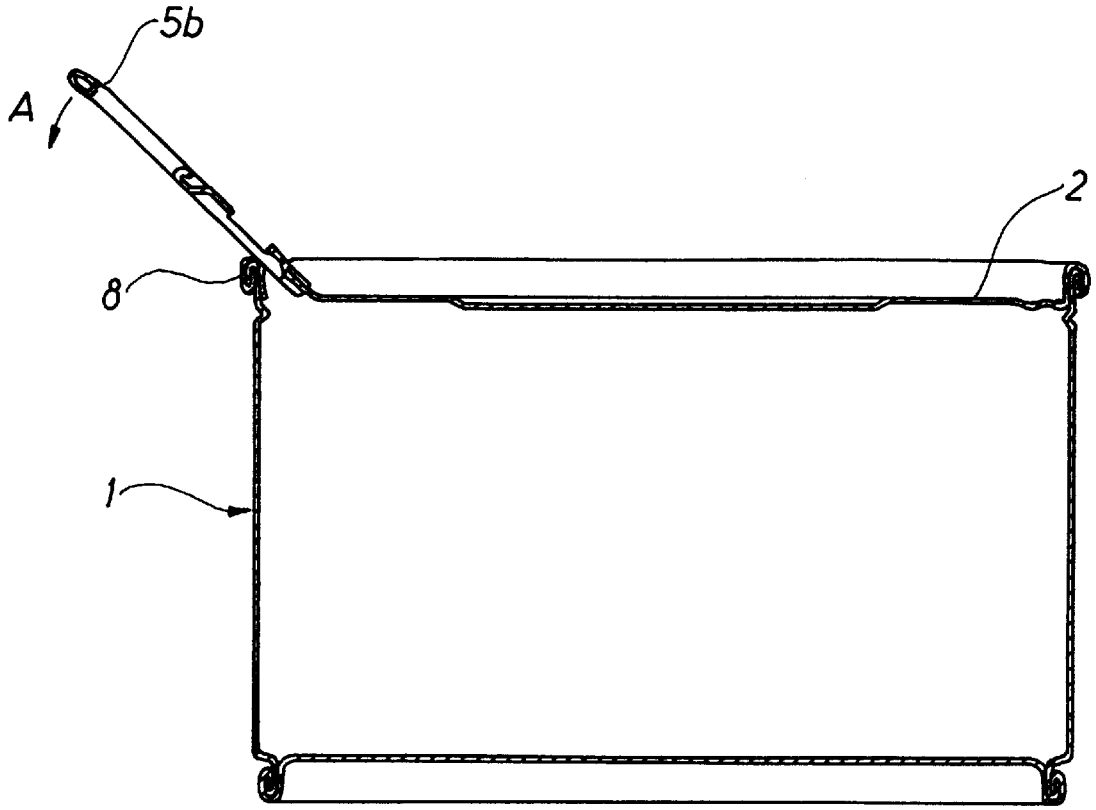
FIG. 5 is a cross sectional view of a can during the opening procedure, whereby the pull ring has been turned 120°, and whereby the cover closing flange forms a support for the pull ring while the cover is being torn up along the score line.

The hollow rivet 9 of the pull ring 5 is made of material from a tearup web 15 defined in the cover by a non-continuous auxiliary score line 14*a*. The tear-up web is arranged substantially below the pull ring 5. When the handle part 5*a* of the pull ring is lifted and turned more than 90° (in FIG. 5 the pull ring is turned approximately 120°), said pull ring farms a type of lifting bar with the cover flange 8 as support. When the handle part 5*a* is pressed in a direction of the arrow A, the score line 7 is broken up efficiently along a distance in such a manner that users can pull away the cover from the body of the can.

Figure 6:
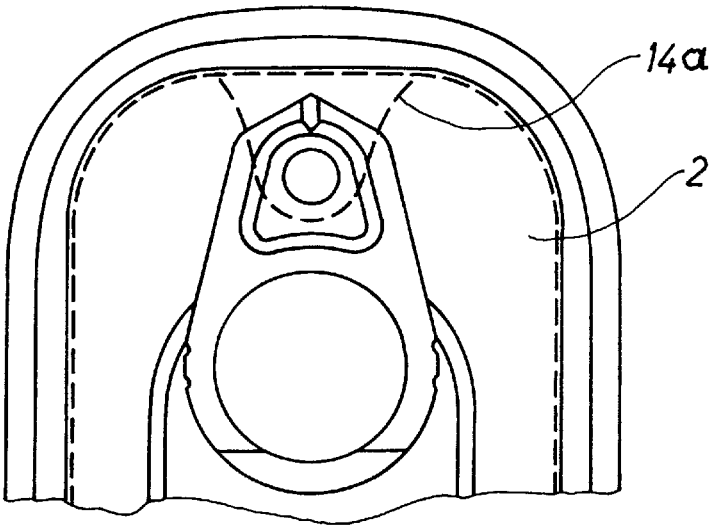
FIG. 6 illustrates a portion of a cover, where the auxiliary score line is bell-shaped.

As shown in FIG. 6, the auxiliary score line 14*a* can be substantially bell-shaped, the broadest portion of the "bell" then facing the score line 7. A short distance, but preferably at least 2 mm, exists between the "bell" and the score line 7.

Before the handle part is lifted by the user, the distance a between the tip of the nose 5*b* and the inner wall of the cover flange 8 when seen in the radial direction can be approximately 2 to 4 mm, preferably 2.5 to 3.5 mm. It is evident that the previously described distance x is slightly shorter than this distance a.

The body of the can 4, the cover member 2 and the bottom member 3 can be made of metal sheet of a thickness of 0.5 to 1.5 mm, but many other wall thicknesses can, of course, also be chosen.

The invention may be modified in many ways without thereby deviating from the scope thereof.

What is claimed is:

1. A can comprising:

a body, a cover, and a bottom member; wherein the cover includes (i) a pull ring including a handle part, and a nose having a tip, (ii) a circumferential cover closing flange shaped between the cover and the body, and (iii) a portion forming a primary score line adjacent the cover closing flange;

the body includes a lowermost necked-in portion; and the bottom member includes (i) a circumferential bottom closing flange securing the bottom member to the necked-in portion of the body, and (ii) a bottom surface;

wherein the nose of the pull ring is spaced a distance x from the score line such that when two of the cans are placed one on top of the other, the bottom flange of the upper of the two cans is located between the cover flange and the nose of the lower of the two cans;

wherein the bottom flange has a height such that, when two of the cans are placed one on top of the other, the bottom flange of the upper of the two cans stands directly on the cover of the lower of the two cans without touching the pull ring of the lower can, and without the bottom surface of the bottom member of the upper can touching the pull ring of the lower can; and wherein when a user pulls in the handle part of the pull ring, the pull ring is adapted to be displaced a distance, corresponding to the distance x, outwards towards the cover closing flange before the tip of the nose of the pull ring is forced downwards into the score line of the cover;

wherein the pull ring further includes an intermediary portion arranged between the handle part and the nose of the pull ring; the cover further includes a rivet riveting the intermediary portion of the pull ring to the cover; the intermediary portion of the pull ring forms a slit extending around the rivet, said slit having a hollow side facing away from the nose of the pull ring; and the cover forms an auxiliary score line adjacent a portion of the primary score line, the auxiliary score line having a narrower end and a broader end, said broader end facing said portion of the primary score line.

2. A can according to claim 1, wherein the slit of the pull ring is substantially U-shaped.

3. A can according to claim 1, wherein the slit of the pull ring is substantially lyre-shaped.

4. A can according to claim 1, wherein the auxiliary score line is substantially U-shaped.

5. A can according to claim 1, wherein the auxiliary score line is substantially bell-shaped.

6. A can according to claim 1, wherein the distance x is between 1 to 3.5 mm.

7. A can according to claim 1, wherein the auxiliary score line is spaced from the primary score line.

8. A can according to claim 7, wherein the auxiliary score line is spaced from the primary score line by at least 2 mm.

9. A can according to claim 1, wherein the tip of the nose and the cover closing flange are spaced apart, in a radial direction, approximately 2 to 4 mm.

10. A can according to claim 9, wherein the tip of the nose and the cover closing flange are spaced apart, in the radial direction, approximately 2.5 to 3.5 mm.

11. A can according to claim 1, wherein the body, the cover member and the bottom member of the can are made of sheet metal having a thickness of 0.1 to 1.5 mm.

* * * * *